US005927170A

United States Patent [19]

Grill et al.

[11] Patent Number: 5,927,170

[45] Date of Patent: Jul. 27, 1999

[54] METHOD AND APPARATUS FOR CUTTING AND STACKING SHEETS OF A WEB MATERIAL

[75] Inventors: Martin Grill, Mantel; Paul Engel, Weiden, both of Germany

[73] Assignee: BHS Corrugated Maschinen-und Anlagenbau GmbH, Weiherhammer, Germany

[21] Appl. No.: 08/831,701

[22] Filed: Apr. 10, 1997

[30] Foreign Application Priority Data

Apr. 19, 1996 [DE] Germany ..... 196 15 560

[51] Int. Cl.[6] ..... B26D 7/06

[52] U.S. Cl. ..... 83/27; 83/29; 83/43; 83/45

[58] Field of Search ..... 83/27, 29, 43, 83/44, 45, 47

[56] References Cited

U.S. PATENT DOCUMENTS 3,796,117 3/1974 Mukai et al. ..... 83/65
4,120,221 10/1978 Speich ..... 83/62.1
4,197,773 4/1980 Kunzmann et al. ..... 83/365
4,548,594 10/1985 Lotz ..... 83/98
4,559,855 12/1985 Schieck ..... 83/425.3
4,699,031 10/1987 D'Angelo et al. ..... 83/42
4,805,501 2/1989 Nuttin ..... 83/345
4,983,155 1/1991 Stobb ..... 83/155
5,189,934 3/1993 Davidson et al. ..... 83/153
5,421,227 6/1995 Rohrdanz et al. ..... 83/42

*Primary Examiner*—M. Rachuba
*Attorney, Agent, or Firm*—Dennison, Meserole, Scheiner & Schultz

[57] ABSTRACT

The invention relates to a method and apparatus for producing and stacking sheets cut from a web of material, in which by longitudinal cutting, at least two web sections 7*a*, 7*b* of predetermined width are cut from the web of material 7, by transverse cutting, a predetermined number of sheets of material of desired length are cut from each of the web sections 7*a*, 7*b*, and the cut sheets are delivered to stackers which stack the cut sheets according to the different cut formats.

12 Claims, 2 Drawing Sheets

METHOD AND APPARATUS FOR CUTTING AND STACKING SHEETS OF A WEB MATERIAL

BACKGROUND OF THE INVENTION

The invention relates to a method and an apparatus for producing and stacking sheets cut from a web of material, in particular a cardboard web.

In systems for producing cardboard sheets of a desired format, a continuous web of material is first produced and then cut apart into sheets of the desired format by means of cutting devices. This requires at least one longitudinal cutter device for cutting individual web sections out of the continuously fed web and at least one crosswise cutter device, which from the web sections cuts the final sheets of the desired format.

These sheets are then delivered in the form of stacks by means of a stacking apparatus. One such stacking apparatus for stacking cardboard sheets as a rule includes one feeder apparatus per web section, on which feeder apparatus the individual sheets, cut from the applicable web section and after being cut crosswise, are delivered in the form of an offset or staggered stream of sheets overlapping one another.

Each stream of sheets is thus fed to a stacking device, also called stacker. In such a stacker, the sheets are combined into stacks of predetermined height, and once the desired stack height or the desired number of sheets per stack is reached, the stack is conveyed out of the stacker, so that the next stack can be created. A stacking apparatus of this kind is described for instance in European Patent Disclosure EP 0 211 996 A1.

Since it takes a certain length of time to remove a finished stack from the stacker, a sufficient gap must be created in the stream of sheets fed to the stacker, because otherwise the result would be a defective stacking process. However, the requirement to form a gap in the stream of sheets limits the production speed of the overall system.

Stacking apparatuses with two stackers have therefore been created, between which it is possible to switch back and forth by means of a shunt disposed in the feeder apparatus.

In this way the advantage is attained that the gap to be created in the stream of sheets need correspond only to a period of time that the shunt requires to switch over from one stacker to the other.

If not only a single web section of predetermined width but instead at least two web sections, which it is understood may be of different widths, are cut from the continuously produced cardboard web, then typically a stacking apparatus is used that has one feeder apparatus for the sheets cut from each web section. Thus at least one stacker for each feeder apparatus must be provided.

For optimal utilization of the continuously produced cardboard web, it is necessary that the individual jobs for each web section be associated with one another as much as possible such that the least possible amount of blanking waste occurs. A job is defined by a predetermined number of sheets of the same format. One job therefore corresponds to a certain total length of one web section.

Until now, when at least two partial jobs were being executed simultaneously from an originally single web of cardboard, the procedure was such that from a plurality of jobs to be executed, the jobs to be executed in parallel were selected in such a way that both upon the transition from one job for one web section to the applicable other job and during the execution of two jobs, the least possible blanking waste occurs.

If the jobs to be executed with the individual web section end at very different times or at correspondingly different locations with respect to the web length, and if the job that ends earlier is followed by a job with a shorter sheet width, then typically this is a point of major blanking waste.

Moreover, this known method has the disadvantage that in the event that very large jobs are to be executed with both web sections, there is no possibility of slipping in a higher-priority job involving at least one web section in between.

OBJECTIONS OF THE INVENTION

The object of the present invention is to create both a method and an apparatus for producing and stacking sheets cut from a web of material, in particular a cardboard web, in which the blanking waste, especially after a change of format after one job with one web section is ended, is to be reduced compared with the known method. Moreover, the possibility should be created of making the execution of jobs flexible.

Because it is possible upon a format change involving the width of the first of the at least two web sections as a consequence of a new job involving the first web section to interrupt the ongoing job involving the second of the at least two web sections, at least whenever the ongoing job for the second web section cannot be executed simultaneously with the job of the first web section, the advantage is attained of an overall reduced blanking waste, or more-flexible reaction to production specifications. Since jobs need not each be executed in one piece, jobs to be executed in parallel can be combined more flexibly. The possibility is also created of slipping higher-priority jobs in immediately after the job involving the first web section ends and thus to keep the blanking waste low by providing that the ongoing job involving the second web section is interrupted and a suitable job is slipped in between.

The preferred embodiment of the method of the invention prevents any interruption of the new job that is to be executed after the job involving the second web section has been interrupted.

This has the advantage that this web section, or the transport apparatus for this web section, need be assigned only two stackers. After the interruption of the ongoing job involving the second web section, a switch over to the available other stacker is made, and the job that has been slipped in between is executed to completion. A switch back to the original stacker can then be made, and the interrupted job can be resumed.

If necessary, in the method of the invention a job can naturally be interrupted multiple times, and preferably each job slipped in between is then not interrupted.

In a feature of the method of the invention, the job for one, a plurality, or all of the web sections can be interrupted, even independently of a change of format in the width of another web section, in order to enable executing jobs of higher priority. It is also possible for only a single web section to be cut from the web of material fed.

In the case where there are two web sections, it is of course also possible that the interruption of one job also interrupts the other job, if the latter job cannot be executed together with the higher-priority job. Since in that case both jobs have to be interrupted, it is necessary for each web section to be assigned at least two stackers.

In the preferred embodiment of the method of the invention, one web of material is used as a master web section, and the jobs of the at least one further web section are interrupted as a function of the jobs of the master web section. In the preferred embodiment, the jobs of the master web section cannot be interrupted. It is thus attained that the master web section need be assigned only a single stacker.

If it is desired that the jobs of the master web section also be interruptible in order to execute jobs of higher priority, then as already noted, the master web section must also be assigned at least two stackers.

Although the method of the invention is as a rule used in conjunction with stackers for the delivery of stacked sheets of material, it is naturally also conceivable for the sheets of material from a job to be scheduled and delivered in some other way.

The apparatus for performing the method of the invention includes a longitudinal and, at least one crosswise conventional cutter, a stacking unit for stacking the sheets, comprising at least three stacking devices, of which two stacking devices are assigned to one of the at least two web sections. The method according to the invention is realized by means of a control unit that suitably effects the longitudinal cutter, the crosswise cutter, and the switchover of the feeding device between the two stacking devices assigned to one web section.

In the event that none of the stacking devices is occupied for temporarily storing an interrupted job, the two stacking devices assigned to one web section can be controlled in a known manner, to increase the speed, such that a switchover to the free stacking device is made in each case if the capacity of the other stacking device is exhausted and that stacking device must be emptied.

Conversely, if one of the stacking devices is occupied for temporarily storing an interrupted job, then the control unit can control a device for offsetting the sheets of material of this web section such that if the capacity of the active stacking device is exhausted, a gap is created in the offset stream of sheets such that enough time remains to empty the stacking device.

If only a single web section is to be cut from the web of material fed, and a job completed with this web section is to be interruptible so that a higher-priority job can be slipped in between, then naturally the corresponding apparatus need have only two stackers, between which it is possible to switch back and forth.

Further embodiments of the invention will become apparent from the claims.

DETAILED DESCRIPTION OF THE INVENTION

The invention will be described in detail with reference to the drawings.

Figure 1:
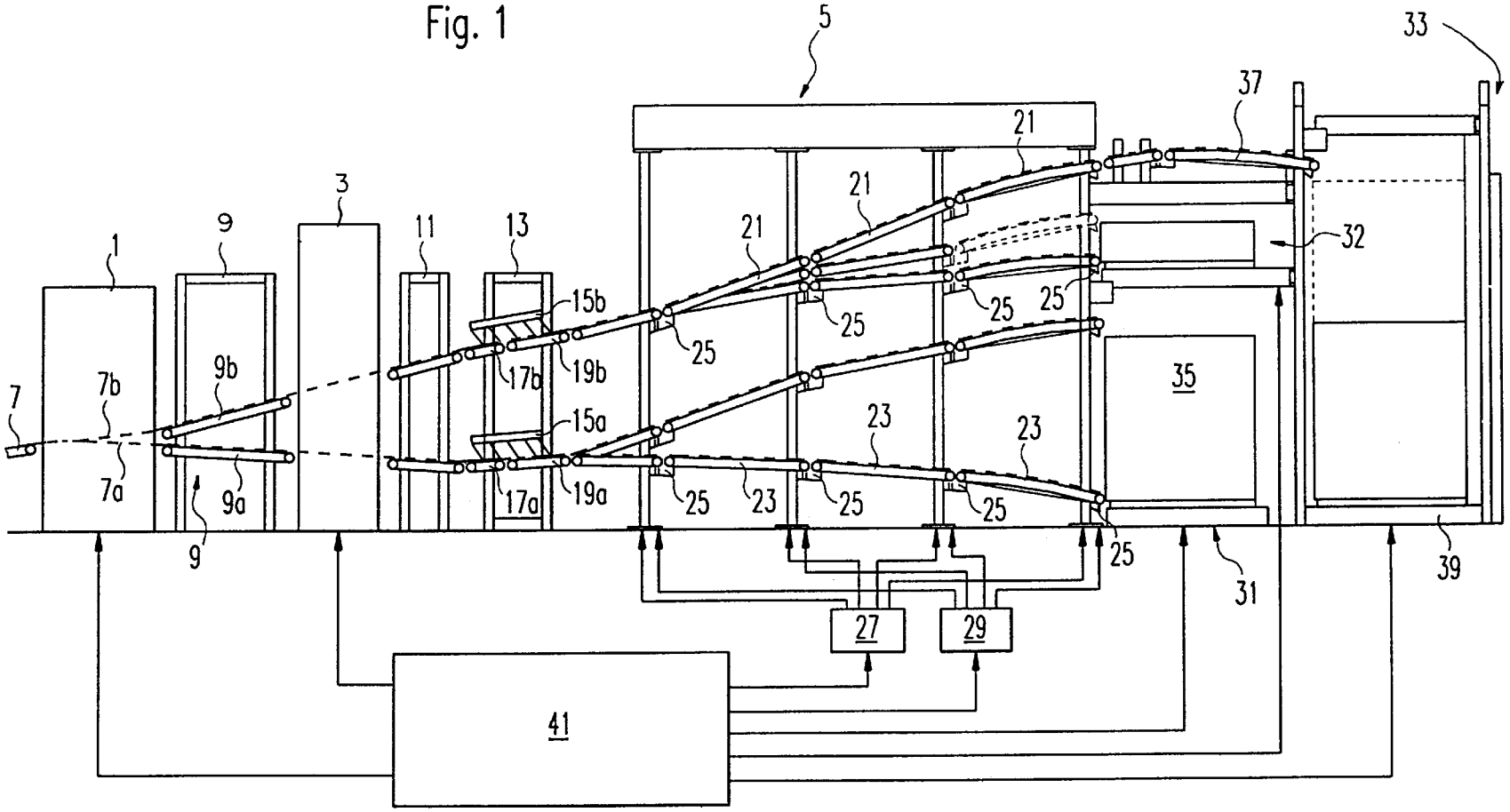
FIG. 1, is a schematic illustration of one embodiment of the apparatus according to the invention.

The apparatus for producing and stacking sheets cut from a cardboard web, in accordance with FIG. 1, essentially includes a longitudinal cutter device 1, a crosswise cutter device 3, and a stacking unit 5.

A cardboard web 7 produced in endless fashion is fed to the longitudinal cutter device 1 and is cut by the longitudinal cutter device 1 into two web sections 7*a* and 7*b*, each of predetermined width. As a rule, the cardboard web 7 is additionally trimmed on the outer edges, in order to assure a clean cut edge on the respective outer sides of the web sections 7*a* and 7*b* as well. The web sections 7*a*, 7*b* are fed to the crosswise cutter device 3 by means of a first guide and transport apparatus 9. This may, as shown in FIG. 1, be a duplex crosswise cutter, to which the web sections 7*a* and 7*b* are fed, each at a different level.

To that end, the guide and transport apparatus has one endless conveyor belt 9*a*, 9*b* for each web section 7*a*, 7*b*, the belts forming an angle corresponding to the different levels. The web sections 7*a*, 7*b* fed to the crosswise cutter device are cut by it, crosswise to the feeding direction, into cardboard sheets of predetermined length.

The completely cut cardboard sheets of each web section are fed by a second guide and transport apparatus 11 to an offsetting station 13, which has one group each of brushes 15*a*, 15*b* that are assigned to the respective web sections 7*a* and 7*b*. By means of the brushes 15*a*, 15*b*, the arriving cardboard sheets are slowed down and shaped into an offset stream of sheets. To that end, the offsetting station 13 has endless conveyor belts 17*a*, 17*b* on the inlet side, which convey the sheets of cardboard at the same speed as the first and second guide and transport apparatuses. On the outlet side, the offsetting station 13 has endless conveyor belts 19*a*, 19*b*, which feed at a speed lower than that of the endless conveyor belts 17*a*, 17*b*. Because of the different feeding speeds and the groups of brushes 15*a*, 15*b* engaging the top side of the cardboard sheets, a uniform offset stream of the cardboard sheets cut from each web section is created.

These offset streams of sheets are fed to the stacking unit 5, which has a plurality of endless conveyor belts 21 and 23, connected one after the other, for the sheet stream of each web section.

The conveyor belts 21 and 23 are each supported in the region of their ends by vertically movable shelves 25. The shelves 25, disposed one above the other, are engaged by a chain, not shown in detail, of a chain drive, also not shown.

The various shelves 25 disposed vertically one above the other are each movable vertically separately from one another. The vertically movable shelves 25 belonging to one web are coupled together such that the desired uniform course of the path created by the endless conveyor belts connected one after the other is achieved. To that end, the shelves 25 belonging to one web section can for instance be connected to the drive chain by means of different sizes of chain wheels. Since the vertical adjustment path of the shelves 25 belonging to one web section increases toward the outlet of the stacking unit 5, the diameter of the chain wheels of the shelves 25 assigned to one web section must increase in the direction of the downstream stackers.

Naturally it would also be conceivable to provide one separate drive mechanism for each shelf 25; the drives would have to be controlled accordingly.

In FIG. 1, the coupling of the shelves 25 of each web section, comprising the endless conveyor belts 21 and 23, is shown only schematically; the assumption is one separate drive mechanism for each shelf 25. The coupling of the shelves of the web section comprising the conveyor belts 21 and 23 is accomplished by suitable control with one control unit 27 for each of the conveyor belts 21 and one control unit 29 for each of the conveyor belts 23.

A total of three stacking devices 31, 32 and 33 are provided in the outlet region of the stacking unit 5. The offset stream of sheets produced from the web section 7*a* can be fed to the stacking device 31 by means of the endless conveyor belts 23. The stacking device 31 shown in FIG. 1 is a so-called up-stacker. In this kind of stacker, the sheets are formed into stacks on a vertically rigid shelf by moving the endless conveyor belts 23 slowly and steadily upward by means of the shelves 25. The speed of the upward motion is essentially equivalent to the speed of the increase in height of the stack 35 formed.

The stacker 32, to which the offset stream of sheets produced from the web section 7*b* can be fed by means of the endless conveyor belts 21 is in principle embodied in the same way. However, since one further guide and transport apparatus 37 is provided above the stacker 32, the stacker 32 can preferably be embodied as a side chamber stacker, as shown in FIG. 1. In that kind of stacker, stacks of only relatively low height are initially formed, and each finished stack is moved laterally out of the chamber, after which higher stacks are formed. This technique is especially suitable for sheet formats of short lengths, because in that case for stability reasons only relatively low stack heights are feasible. If individual stacks are then placed side by side, higher stack heights can also be achieved.

In addition to the stackers 31 and 32 disposed one above the other vertically, one further stacker 33 is provided, which is embodied as a so-called down-stacker. In this type of stacker, the feeding of the offset stream of sheets is effected with a constant vertical position of the feeding conveyor belt of the guide and transport apparatus 37. The applicable stack is formed by providing a vertically movable support plate 39, which at the onset of stack buildup is directed essentially to the feed height of the feeding conveyor belt. As the stack height increases, the plate 39 is then moved progressively downward vertically; the upper end of the stack is preferably always located essentially at the delivery height of the stream of sheets, or just below it. As a result, the fed sheets do not have to fall a relatively long way downward, over the course of which they could wedge against one another and impede correct stack formation.

To control the entire apparatus, a control unit 41 is provided, which controls not only the longitudinal cutter device 1, the crosswise cutter device 3 and the offsetting station 13 but also the stacking unit 5, including the shelves 25 and the stackers 31, 32 and 33. The control of the shelves 25 is effected by supplying control signals to the control units 27 and 29 assigned to the respective endless conveyor belts 21 and 23. The control unit 41 also controls the bottom plate 39 of the down-stacker 33 as well as devices (not shown) for clearing out the chambers of the stackers.

By suitable control of all the above-mentioned components, the method according to the invention, as described below, can be realized.

Figure 2:
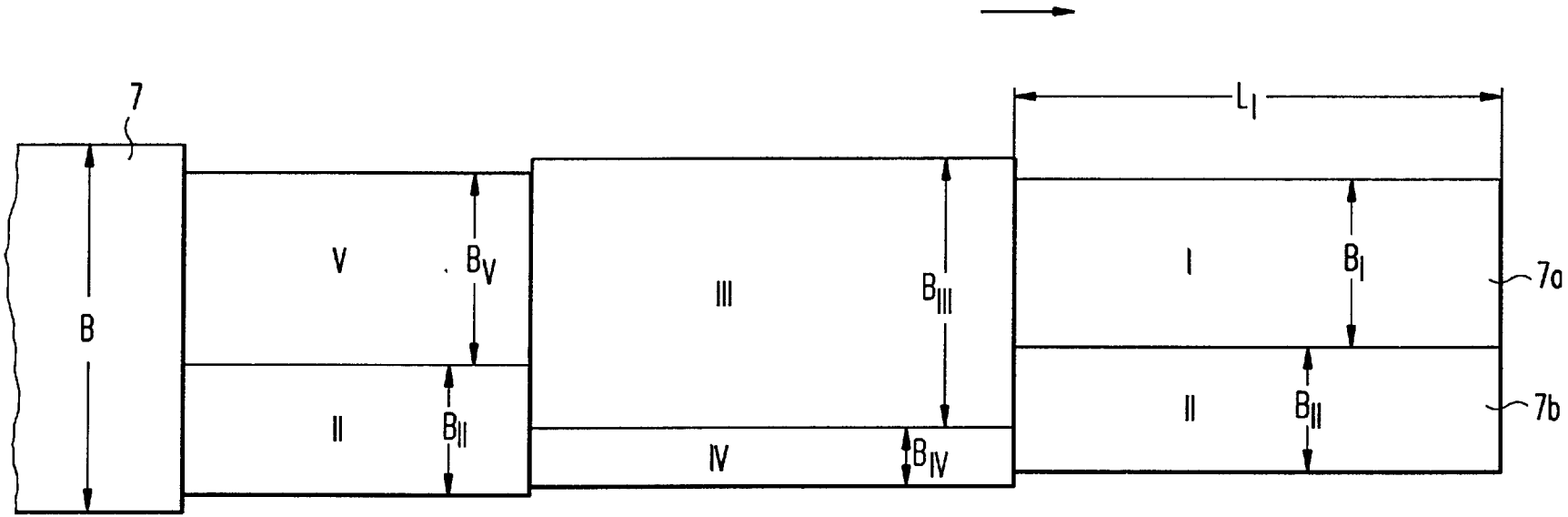
FIG. 2, is a schematic illustration of the execution of different jobs in the event of two jobs to be executed in parallel.

To explain the preferred operation of the invention, FIG. 2 will be referred to below. FIG. 2 schematically shows the execution of various jobs, with two jobs at a time being executed simultaneously. The execution of the jobs takes place from right to left, since in FIG. 2, in accordance with the illustration of the apparatus in FIG. 1, a web of cardboard 7 fed in the direction of the arrow is shown, which is cut into web sections 7*a* and 7*b* in accordance with the width of the respective jobs to be executed simultaneously.

In FIG. 2, it is first assumed that on the first web section 7*a* a job I is first performed; the sheets have a width $B_I$ and the total length of the job, or in other words the added-together length of all the sheets, is equal to $L_I$. Simultaneously with job I, a second job II is performed, whose sheets have the width $B_{II}$.

Once the execution of job I is completed, a further job III is executed with the first web section 7*a*. This job III has a width $B_{III}$, which is great enough that job II cannot be executed simultaneously with job III, since the total width would be greater than the width B of the cardboard web 7 fed.

The invention therefore provides that upon a change of format of the first web section 7*a* at the transition from the first job I to the third job III, the second job II, which is being performed on the second web section 7*b*, is interrupted and instead of the second job II, a fourth job IV is performed on the second web section 7*b*, which has a width $B_{IV}$ that allows simultaneous execution of job IV and III. Once job III and job IV have been executed to completion, a further job V is performed on the first web section, the width of which job $B_V$ is such that it is possible to simultaneously execute job V on the first web section 7*a* and job II on the second web section 7*b*.

In FIG. 2, for the sake of simplicity, it was assumed that jobs III and IV have the same length. It is understood, however, that job IV may also be shorter or longer than job III; in that case, however, there is necessarily some waste, unless a job of suitably shorter length can be slipped in between on the applicable web section.

The completion of the sequence of jobs in FIG. 2 by the apparatus shown in FIG. 1 is carried out as follows:

First, jobs I and II are performed in such a way that the sheets of job I, which have been cut from the web section 7*a*, are stacked in the stacker 31, and the sheets of job II, which have been cut from the web section 7*b*, are stacked in the stacker 33. To that end, the control unit 41 controls the shelf 25 of the stacking unit 5 in such a way that the conveyor belts 23 allow the up-stacking, and the conveyor belts 21 deliver the stream of sheets from the web section 7*b* to the guide and transport apparatus 37. At the same time, the vertically movable plate 39 of the down-stacker 33 is controlled accordingly.

If the length of job I is so great that the maximum stack height in the stacker 31 is reached once or multiple times, then the control unit 41 controls the stacker 31 with one or more clearing commands, whereupon whichever stack is completed is removed from the stacker. This naturally requires creating a gap in the stream of sheets in the web section 7*a*. This is accomplished in a known manner by means of a suitable device, not shown, which is also controlled by the control unit 41.

After the completion of job I, the last stack is conveyed out of the stacker 31. The endless conveyor belts 23 are then returned to the lower position, to allow up-stacking again of the sheets of job III that now has to be finished. At the same time, the endless conveyor belts 21 are moved by the control unit 41 into the position in which the stream of sheets of web section 7*b*, in this case from executing job IV, are fed to the stacker 32.

After the controlling of the longitudinal cutter device 1 and crosswise cutter device 3 by the control unit 41 to the format of the sheets of jobs III and IV that are now to be completed, the sheets of these jobs are therefore stacked in the stackers 31 (job III) and 32 (job IV).

With respect to the timing of the control events described above, the transit time between devices, such as the longitudinal cutter device, the crosswise cutter device and the stackers, must naturally be taken into account.

For the stacks of sheets from job IV in the stacker 32, the shelves 25 of the endless conveyor belts 21 are controlled in the way required for the function of the up-stacker 32.

Once the maximum stack height in the stacker 32 is reached, the endless conveyor belts 21 are returned to the lower position, and the finished stack is removed from the stacker and assembled in the adjacent side chamber to form one complete stack.

Since at the moment of the switchover from job I to job III, an already-begun partial stack will as a rule be located in the stacker 33, the stacker 33 acts as a buffer during the execution of job IV in the stacker 32.

After jobs III and IV (which are assumed to be of equal length here) have been completed, then by means of the stacker 31, job V is continued, and job II which had been begun is resumed; naturally the sheet stream from job II must again be fed to the guide and transport apparatus 37 by means of the endless conveyor belts 21.

In the preferred embodiment of the invention described above, the first web section therefore acts as a master web section, whose jobs are not interrupted. For this reason, only a single stacker, namely the stacker 31, needs to be assigned to this web section.

Depending on the format change in the web section 7*a* as a consequence of a new job, an ongoing job in web section 7*b* can be interrupted; the affected sheets are buffer-stored in the stacker 32 or 33.

Repeated interruption of a job in the web section 7*b* is naturally also possible, but in the case where only two stackers are assigned to the web section 7*b*, the job that has been slipped in between must not be interrupted.

The interruption of a job to be executed in the web section 7*b* is also possible, however, regardless of any format change in the first web section 7*a*. This is on the assumption that the width of the job to be slipped in between on the second web section 7*b* is such that it can be executed simultaneously with the job in progress on the first web section 7*a*. This makes it possible for instance to slip in jobs of higher priority, if very long jobs are to be run on both web sections.

It is understood that this method can be performed even if only a single one of the two web sections is to be cut from the endless cardboard web 7 fed to the longitudinal cutter.

The possibility of interrupting a job on at least one of the web sections enables much more flexible scheduling of jobs to be executed simultaneously than was the case previously. This is true even for the case where only one of the web sections is cut from the web of material 7. That web section is then equivalent to the web piece 7*b* of FIGS. 1 and 2.

We claim:

1. A method for producing and stacking sheets cut from a web of material corresponding to jobs I–V, said method comprising:

a) cutting longitudinally, at least two web sections (7*a*, 7*b*) of predetermined width;

b) cutting transversely a predetermined number of sheets of material of predetermined length from each of the at least two web sections (7*a*, 7*b*);

c) delivering the predetermined number of sheets of material, each corresponding to one of the jobs (I–V), in combined fashion; wherein d) a change in the width of the first (7*a*) of the at least two web sections (7*a*, 7*b*) occurs as a consequence of a new job (III) for the first web section (7*a*), an ongoing job (II) for the second (7*b*) of the at least two web sections (7*a*, 7*b*) is interrupted whenever the ongoing job (II) for the second web sections (7*b*) cannot be executed simultaneously with the new job (III) for the first web section (7*a*);

e) the second web section (7*b*) in accordance with a further new job (IV) for the second web sections is executed simultaneously with the new job (III) for the first web section (7*a*), by cutting longitudinally and transversely;

f) the sheets of material of the new further job (IV) for the second web section (7*b*) are delivered separately from the sheets of material of the interrupted ongoing job (II); and g) a remainder of the interrupted ongoing job (II), is resumed or executed to completion, in response to another chance of predetermined width of the first web section (7*a*) as a consequence of an additional new job (V) which enables the simultaneous execution along with the interrupted ongoing job (II).

2. The method of claim 1, wherein the further new job (IV) is executed to completion without further interruption.

3. The method of claim 2, wherein the job for one and each of the web sections can be interrupted, even independently of a change in the width of the other web section, in order to execute jobs having a priority which is higher than a currently executed job.

4. The method of claim 3, wherein only a single web section is cut.

5. The method of claim 1, wherein one web section (7*a*) is used as a master web section, and the ongoing job (II) of the at least one further web section (7*b*) is interrupted as a function of the jobs (I, III, V) of the master web section (7*a*).

6. The method of claim 5, wherein the jobs (I, III, V) of the master web section (7*a*) are completed and not interrupted.

7. The method of claim 5, wherein the jobs (I, III, V) of the master web section (7*a*) are interrupted in order to execute a job of higher priority such as (II, IV).

8. The method of claim 1 wherein the sheets of material from one of the jobs (I–V) are delivered stacked, and at least one web section (7*b*) is assigned to first and second stacking devices.

9. In apparatus for generating stacks of sheets cut from a web of material, a method of producing a plurality of different jobs, each job consisting of a desired number of sheets, each sheet having a predetermined length and width;

said method comprising:

(a) cutting the web in a longitudinal direction to generate a first width and a second width web section;

(b) cutting portions of said first and second width web sections in a transverse direction to simultaneously generate first and second cut sheets;

(c) changing cutting of the web in the longitudinal direction to generate a third and a fourth width web section;

(d) cutting portions of said third and fourth width web sections in a transverse direction to simultaneously generate third and fourth cut sheets;

(e) changing cutting of the web in the longitudinal direction to generate a fifth width and said second width web section;

(f) cutting portions of said fifth width and said second width web sections to simultaneously generate second and fifth cut sheets; and (g) generating stacks of first, second, third, fourth and fifth cut sheets.

10. The method of claim 9 wherein the steps (a, b) are repeated until a first desired number of first and second cut sheets are generated.

11. The method of claim 10 wherein the steps (b, c) are repeated until a second desired number of third and fourth cut sheets are generated.

12. The method of claim 9 wherein steps (a, b) are repeated a less than desired number of times, followed by repeating steps (c, d) a second desired number of times, and continuing steps (a, b) until the first desired number of second cut sheets are generated.

* * * * *